US006931367B2

(12) United States Patent
Harwood

(10) Patent No.: US 6,931,367 B2
(45) Date of Patent: Aug. 16, 2005

(54) OPTIMAL RIB DESIGN METHOD FOR EXHAUST COMPONENTS

(75) Inventor: Eric Harwood, Toledo, OH (US)

(73) Assignee: Faurecia Exhaust Systems, Inc., Toledo, OH (US)

( * ) Notice: Subject to any disclaimer, the term of this patent is extended or adjusted under 35 U.S.C. 154(b) by 803 days.

(21) Appl. No.: 09/997,645

(22) Filed: Nov. 29, 2001

(65) Prior Publication Data

US 2003/0101030 A1 May 29, 2003

(51) Int. Cl.[7] ..... G06F 17/10; G06G 7/48

(52) U.S. Cl. ..... 703/2; 703/7

(58) Field of Search ..... 703/2, 7; 706/97, 706/98; 700/97, 98; 440/84–88 R; 181/212–215, 204, 210

(56) References Cited

U.S. PATENT DOCUMENTS

| | | | | | |
|---|---|---|---|---|---|
| 4,516,657 | A | * | 5/1985 | Allard | 181/204 |
| 4,909,348 | A | | 3/1990 | Harwood et al. | |
| 5,768,156 | A | | 6/1998 | Tautges et al. | |
| 5,905,502 | A | | 5/1999 | Deering | |
| 5,949,989 | A | * | 9/1999 | Falkowski et al. | 703/8 |
| 6,090,147 | A | * | 7/2000 | Bremner et al. | 703/1 |
| 6,554,099 | B2 | * | 4/2003 | Uegane | 181/275 |
| 6,668,206 | B1 | * | 12/2003 | Akaike et al. | 700/98 |
| 2001/0018995 | A1 | * | 9/2001 | Uegane | 181/275 |
| 2001/0035155 | A1 | * | 11/2001 | Uegane et al. | 123/322 |
| 2002/0061110 | A1 | * | 5/2002 | Kobayashi | 381/71.3 |
| 2002/0088667 | A1 | * | 7/2002 | Naito | 181/252 |
| 2003/0211020 | A1 | * | 11/2003 | Rao et al. | 422/180 |
| 2004/0050618 | A1 | * | 3/2004 | Marocco | 181/248 |

OTHER PUBLICATIONS

Xitian (steve) Fang, Ciray Sam, "Dynamic Analysis & Correlation for Exhaust System", Sep. 22, 2000, PDF file, pp. 1–9.*

Jianbing Huang and Chia–Hsiang Menq, "Automatic Data Segmentation for geometric Feature Extraction From Unorganized 3–D Coordinate Points", IEEE Transactions, vol. 17, No. 3, Jun. 2001, pp. 268–279.*

Ahmed El–Bahrawy, Mattias Nystrom, "Automated Integrated finite Element Analysis Using MSC.Nastran and SDRC/I–DEAS", Lulea University of Technology Volvo Car Corporation, Sep. 22, 2000.*

(Continued)

*Primary Examiner*—Jean R. Homere
*Assistant Examiner*—Mussa Shaawat
(74) *Attorney, Agent, or Firm*—Gerald E. Hespos; Anthony J. Casella

(57) ABSTRACT

A method is provided for designing deformations that will achieve an optimum reduction in vibration related noise in an exhaust system component. The method entails defining an initial shape for an exhaust system component based on available space and exhaust flow characteristics. The shape is converted to a mesh having a plurality of interconnected grids. The mesh then is deformed to define an optimal theoretical configuration for the exhaust system component that will eliminate at least selected natural frequencies. The resulting shape then is converted to a plurality of small flat surfaces that intersect, and a point cloud is created from the array of small flat intersecting surfaces of the optimal theoretical exhaust system component. The point cloud is employed to smooth out intersecting surfaces and to achieve an optimal manufacturable configuration for the exhaust system component.

8 Claims, 10 Drawing Sheets

OTHER PUBLICATIONS

O.Bailly, C.Buchou, A. Floch and L. Sainsaulieu, "Simulation of the Intake and Compression Strokes of a Motored 4–Valve Sl Engine with a Finite Element Code" Oil & Science and Technology–Rev. IFP, vol. 54 (1999), No. 2, pp. 161–168, Editions Technip.*

Hisashi Sano, toshio Inoue, Akira Takahashi, Kenichi Terai, and Yoshio Nakamura, "Active Control System for Low–Frequency Road Noise Combined with an Audio System", IEEE Transactions, vol. 9, No. 7, Oct. 2001, pp. 755–763.*

Myer Kutz, "Mechanical Engineers Handbook", Copyright 1998 by John Wiley & Sons, pp. 276–285, and pp. 311–318.*

Don D. Davis, Jr. George M. Stokes Dewey Moore George L. Stevens, Jr., "Theoretical and experimental Investigation of Mufflers with Comment on Engine–Exhaust Muffler Design", 1954, pp. 1–6.*

* cited by examiner

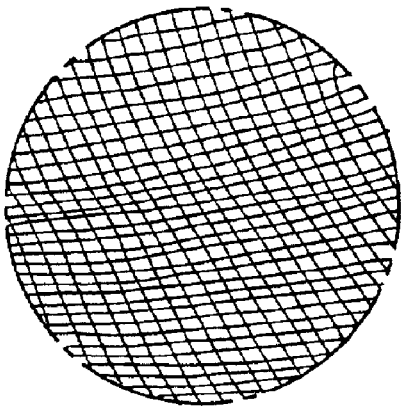
FIG.3A
FIG.4A
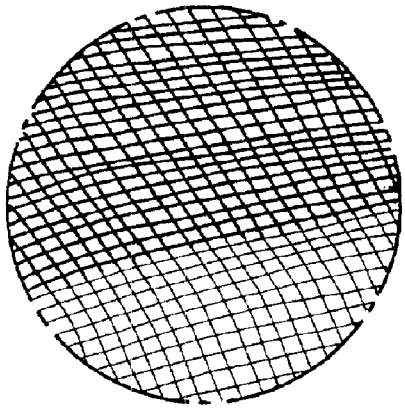
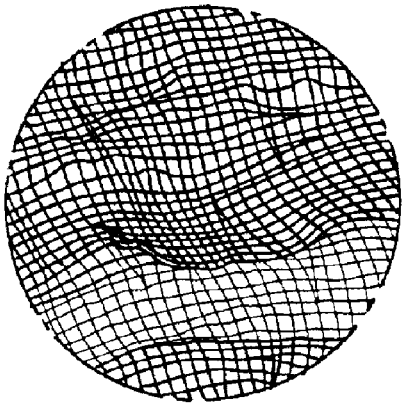
FIG.5A
FIG.5B
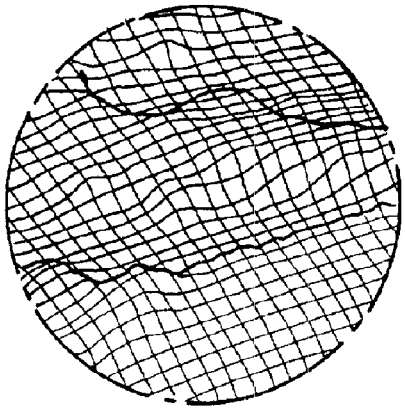

OPTIMAL RIB DESIGN METHOD FOR EXHAUST COMPONENTS

BACKGROUND OF THE INVENTION

1. Field of the Invention

The subject invention relates generally to exhaust systems, and more specifically to the design and location of reinforcing structures on an exhaust system component for minimizing vibration related noise.

2. Description of the Related Art

The exhaust gas system of an automotive vehicle channelizes exhaust gas from the engine to a location where the exhaust gas can be emitted safely. The exhaust system also attenuates noise associated with the engine combustion and the flowing exhaust gas. A typical exhaust gas system includes at least one exhaust pipe that extends from the engine, at least one exhaust muffler that communicates with the exhaust pipe and at least one tail pipe that extends from the muffler. A catalytic converter generally communicates with the exhaust pipe between the muffler and the engine.

The prior art exhaust muffler includes an inlet that communicates with the exhaust pipe, an outlet that communicates with the tail pipe and a plurality of internal tubes and chambers that permit a controlled expansion of the flowing exhaust gas and creates acoustic altering components. The expansion of the exhaust gas dissipates the energy associated with the flowing exhaust gas and significantly reduces noise levels. Noise levels are reduced when they encounter acoustic altering components.

Engineers can design the internal components of a muffler based on exhaust gas flow characteristics and acoustic output of the engine. The design process generally is iterative. Thus, a prototype muffler may be developed based on flow characteristics and acoustic output of the exhaust gas. The prototype muffler then is bench tested with the engine, and noise output is analyzed. The array of tubes and chambers in the muffler then may be altered in an effort to optimize the performance of the muffler.

Most prior art mufflers comprise an array of conventional cylindrical pipes that are supported parallel to one another by a plurality of transverse baffles. The subassembly of pipes and baffles is slid into a tubular outer shell so that the baffles and the outer shell define chambers within the muffler. Some tubes are perforated within certain of the chambers, while other tubes may dead end within a chamber. Opposed end caps or headers are mounted to opposite ends of the tubular outer shell. One end cap typically is provided with an inlet to which the exhaust pipe is mounted. The opposed end cap typically is provided with an outlet to which the tail pipe is mounted.

The prior art also includes stamp formed mufflers. A stamp formed muffler includes plates that are stamped to define channels. The plates are secured in opposed relationship to one another so that the channels register. A registered pair of channels defines the functional equivalent of a conventional tube. The prior art stamp formed muffler further includes a pair of stamp formed outer shells that are secured around the tubes defined by the internal plates. Peripheral portions of the outer shell and at least one of the internal plates are secured to one another to define the chambers that communicate with the tubes formed by the internal plates. The outer shells further are formed to define at least one inlet and at least one outlet.

Exhaust system components must compete with other required components of a vehicle for the limited available space on a vehicle. Conventional tubular mufflers have few options for the size, shape and location of inlets and outlets. Thus, conventional tubular mufflers are not well suited for the many applications where the available space is very limited. Stamp formed mufflers, on the other hand, are not limited to a tubular shape and do not require the inlet and outlet to be on opposite ends of the muffler. Hence, stamp formed mufflers provide more design options than conventional tubular mufflers and are more desirable in many situations.

The noise associated with an automotive exhaust system is not limited to noise generated by the flowing exhaust gas. More particularly, forces exerted by the flowing exhaust gases and forces created by the acoustic and vibration energy of the engine cause panels of both a conventional tubular muffler and a stamp formed muffler to vibrate. The vibrations that coincide with the natural frequencies in the shell of the muffler are amplified. The first several natural frequency modes can generate objectionable noise independent of the noise associated with the exhaust gas.

Exhaust system manufacturers typically have dealt with the problem of vibration related noise by forming ribs in the outer shell and by providing a separate outer wrapper. The ribs and the outer wrapper are intended to provide enhanced rigidity, and to thereby minimize vibration related noise. The design and location of ribs generally has not been very scientific. A typical muffler with a tubular outer shell will include an array of parallel spaced apart ribs that extend longitudinally along the muffler. The spacing and size of the ribs on conventional tubular mufflers has been dictated mostly by the equipment used to create the ribs, and hence has not varied significantly from one muffler to another. Some muffler manufacturers consider their rib pattern to function as a trademark, and hence there has been little incentive to optimize the rib design. Stamp formed mufflers also have included parallel ribs. Although stamp formed mufflers have taken many shapes, the ribs typically have extended generally transverse to the longitudinal direction of the muffler. Slight variations in the rib pattern on a stamp formed muffler might be made as part of the above-described iterative design of a muffler. However, such design variations typically would follow the prevailing trend of parallel ribs, and redesign efforts typically have been based on trial and error.

Exhaust system manufacturers are under substantial pressure to reduce the weight of an exhaust system. Additionally, automobile manufacturers typically out-source the design and manufacture of exhaust systems, and price is an important factor in the selection of a supplier. Cost and weight savings can be achieved by employing thinner metal for the muffler or by eliminating the outer shell. However, vibration related noise is likely to increase when thinner metal is used for the muffler or when an outer shell is eliminated.

Software has been developed by Altair Engineering and sold under the trademark OPTISTRUCT® to identify locations on panels of a muffler, oil pan or the like that will vibrate at selected natural frequencies. The software is employed by inputting data to define the size and shape of the panel. The software then identifies locations that will vibrate at selected natural frequencies and outputs a theoretical shell geometry that would substantially reduce vibrations at the selected natural frequencies. The theoretical shell geometry, however, generally will require a three-dimensional matrix with tens of thousands of intersecting surfaces. Hence, the theoretical shell geometry produced by the OPTISTRUCT® software is acknowledged to be unmanufacturable, and merely is used as a guide for developing a more effective pattern of parallel ribs. For example the OPTISTRUCT® identification of locations that will vibrate at the selected natural frequencies and the theoretical shell geometry may be presented to an engineer who will design parallel ribs at locations that will vibrate at the selected natural frequencies and at locations that appear to require reinforcement for other reasons. The geometric changes that result from this proposed rib pattern will be inputted to the OPTISTRUCT® software, and a new simulation will be run to determine whether vibrations at the selected natural frequencies have been avoided. Alternatively, the engineer may input data regarding minimum rib width, recommended cross-sectional angles for each rib and maximum rib depth. The software then will recommend one or more optional rib patterns that will eliminate or substantially reduce vibration at the selected natural frequencies. Thus, the OPTISTRUCT® software can be used as part of an effort to reduce weight and costs.

An object of the invention is to provide an efficient method for designing ribs in a muffler to provide optimum resistance to vibration related noise with reduced material thicknesses.

SUMMARY OF THE INVENTION

The subject application is directed to a method for designing a specific shape for a muffler that optimizes vibration resistance. The method comprises an initial step of inputting an initial shell geometry as dictated by exhaust gas flow characteristics and available space. The input may define an array of X, Y and Z coordinates. The method then comprises converting the initial shell geometry into a mesh comprising a plurality of grid squares.

The method proceeds by identifying locations on at least one panel that will exhibit natural frequencies of interest and then simulating an optimal hypothetical deformation of the mesh to maximize resistance to the natural frequencies of the panel. The simulation of the optimal hypothetical deformation will define an optimal theoretical shell geometry that is substantially unmanufacturable in view of the large number of very small planer surfaces created from the deformed mesh. The step of simulating the deformed mesh may be carried out using the OPTISTRUCT® software marketed by Altair Engineering.

The method continues by projecting onto the unmanufacturable optimal theoretical geometry, a two-dimensional point cloud that defines a grid with points spaced by a minimum desired radius of bend for the selected metal sheet material. This projection produces a three-dimensional representation of the optimal theoretical geometry. Smooth surfaces are then created from the point cloud to produce a manufacturable shape substantially conforming to a major portion of the surfaces defined by the optimal hypothetic geometry of the deformed mesh.

The method substantially reduces time that would otherwise be required to design and test conventional ribs. Additionally, the resulting muffler reduces the number of natural frequencies that generate vibration related noise, while simultaneously reducing material thickness and weight.

BRIEF DESCRIPTION OF THE DRAWINGS

FIGS. 3 and 3A are a perspective view of a panel mesh based on the panels of the muffler shell shown in FIG. 1.

FIGS. 4 and 4A are an organized mesh showing the mesh of FIG. 3 for the panels that exhibit the first natural frequency.

FIGS. 5, 5A and 5B show the optimal theoretical deformation of the mesh for the targeted panels shown in FIG. 4.

DETAILED DESCRIPTION OF THE PREFERRED EMBODIMENT

Figure 1:
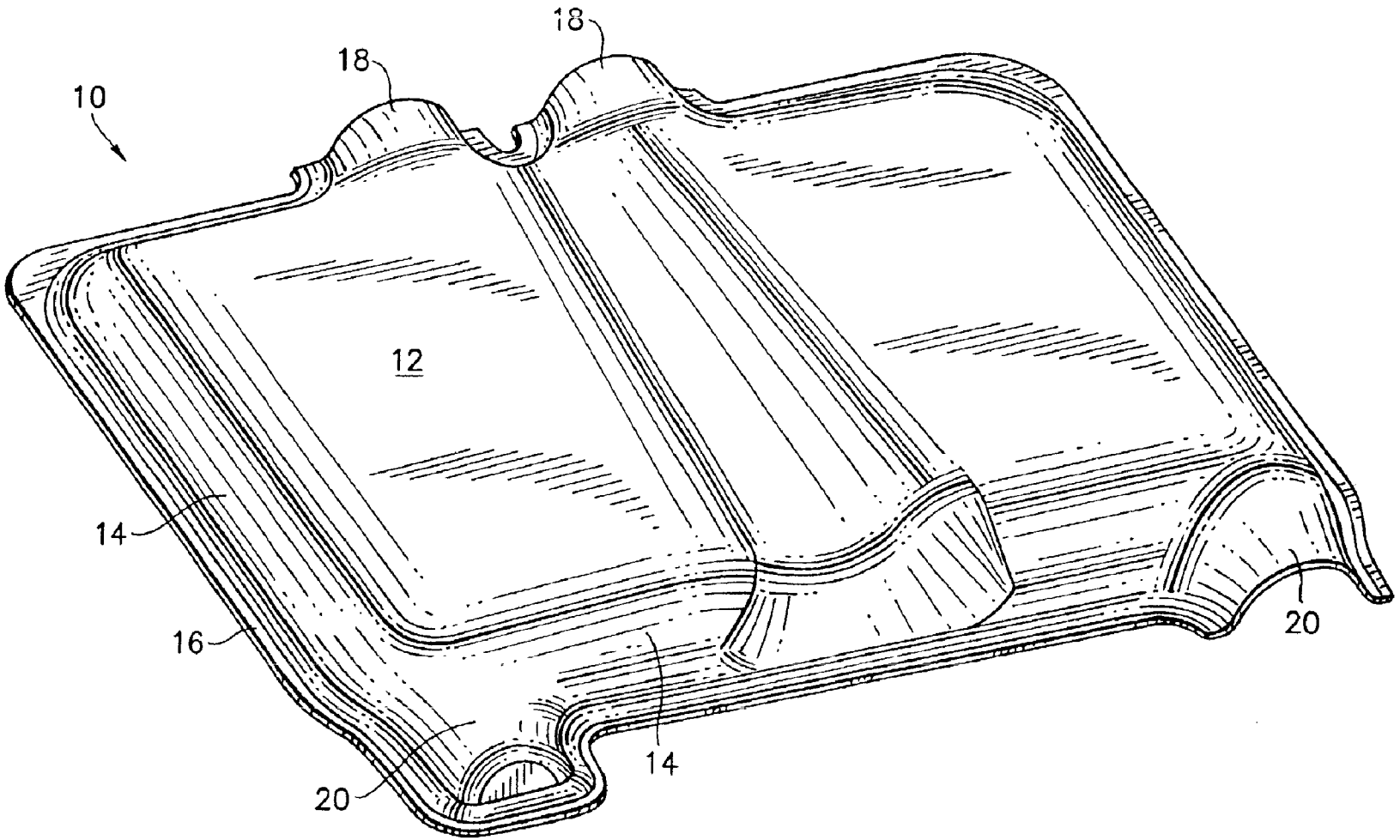
FIG. 1 is a perspective view of a stamp formed muffler shell in accordance with the subject invention.
Figure 9:
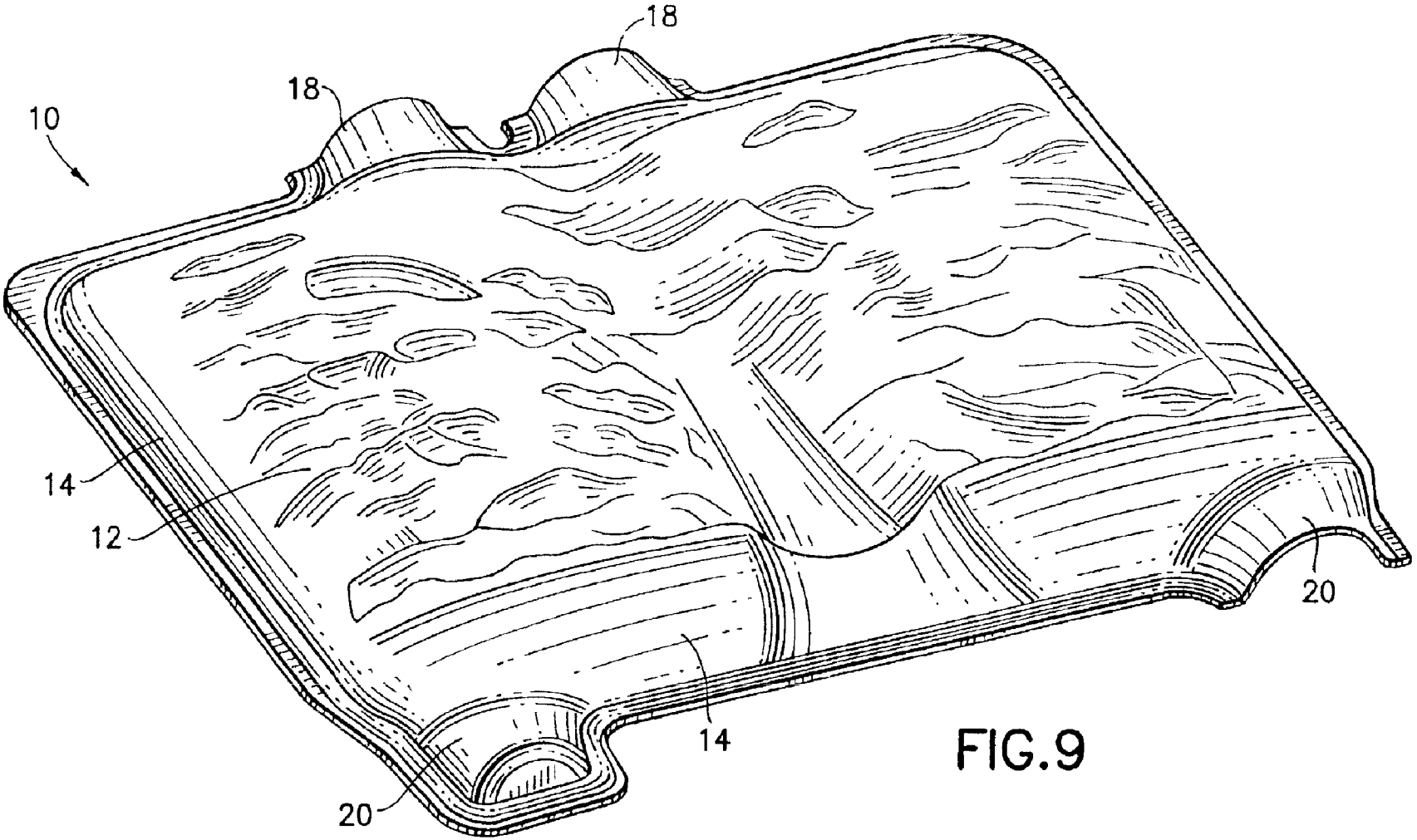
FIG. 9 is a perspective view similar to FIG. 5, but showing the optimal manufacturable geometry achieved by the smoothing shown in FIGS. 7 and 8.

A muffler shell in accordance with the invention is identified generally by the numeral 10 in FIGS. 1 and 9. The muffler shell includes a bottom panel 12, a plurality of side panels 14 extending angularly from the bottom panel 12 and a peripheral flange 16 extending from the side panels 14 for engagement with a corresponding peripheral flange of another shell of the muffler. An inlet channel 18 and an outlet channel 20 are formed adjacent the peripheral flange 16 and side panels 12 to enable an exhaust pipe and tail pipe to communicate with internal components of the muffler.

Figure 2:
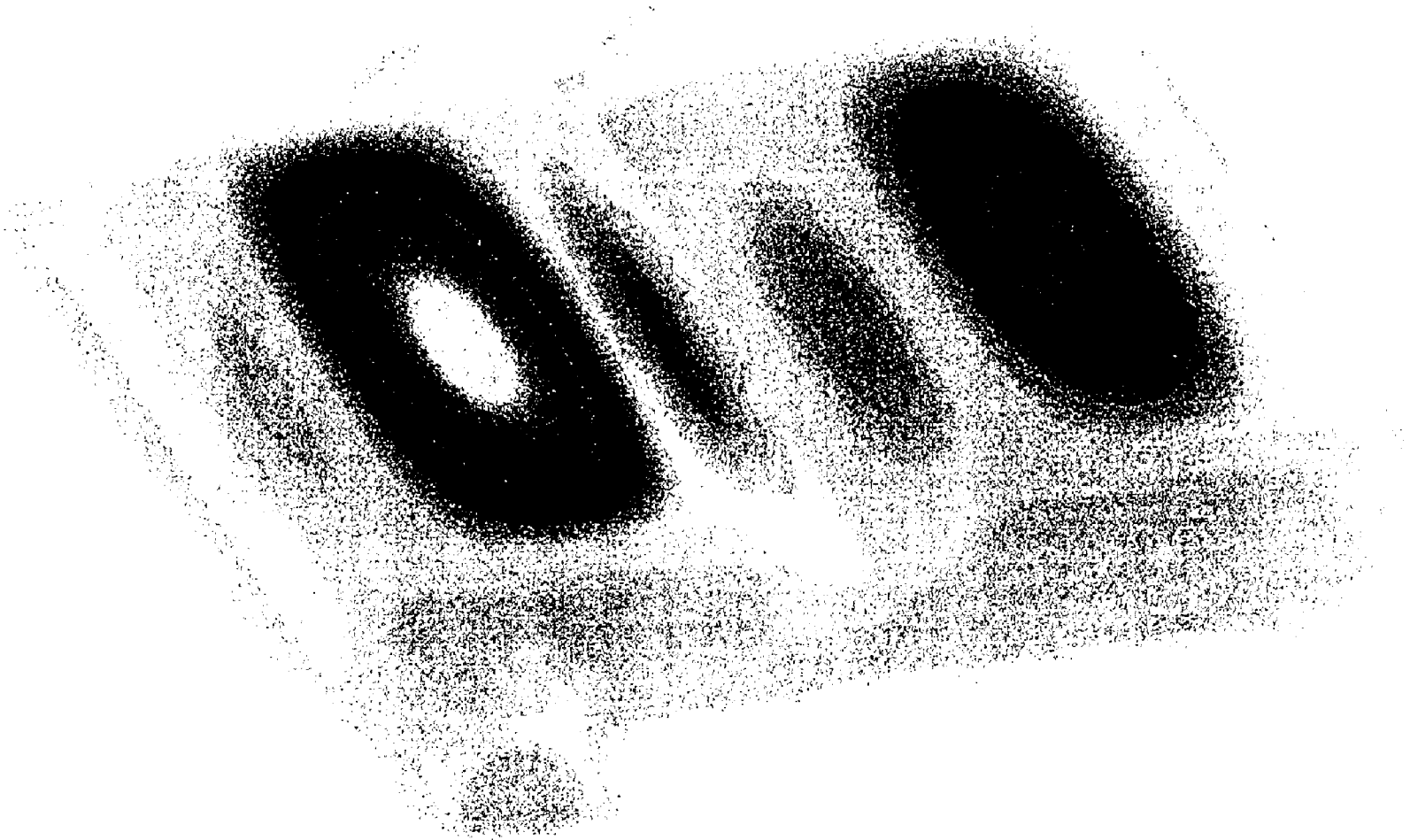
FIG. 2 is a perspective view of the muffler shell showing the location of the first natural frequency.

Certain regions on the larger bottom panel 12 of the muffler shell 10 vibrate at selected natural frequencies well within the audible range. The location of these regions is determined by known analytical techniques. The locations of regions that will vibrate at the first natural frequency are illustrated in FIG. 2. Locations that have other natural frequencies can be determined in a similar manner. In a typical muffler, the first through tenth natural frequency modes will have frequency values that are of interest, and the locations of these natural frequencies is determined by known analytical techniques.

Figure 3:
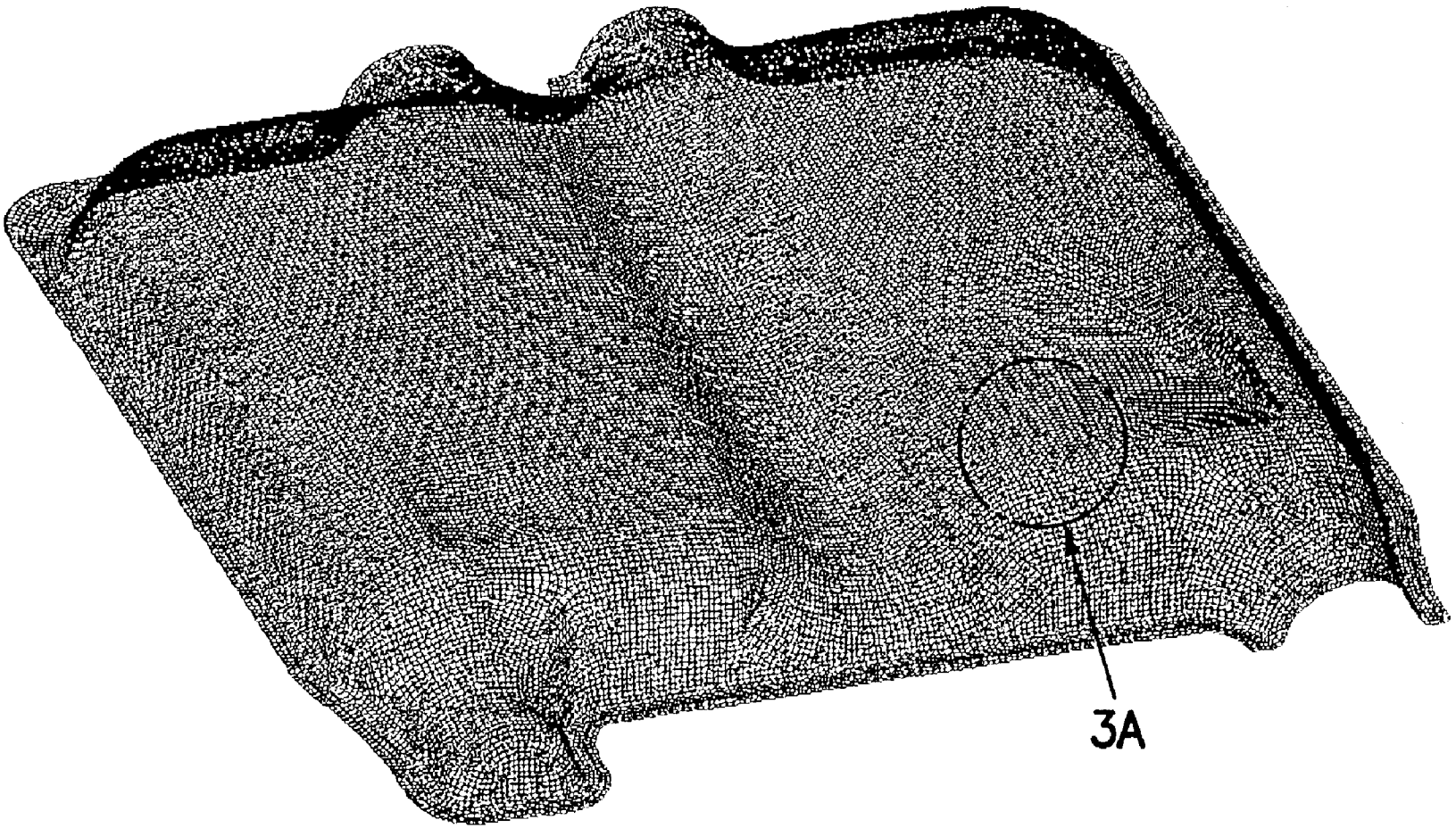

Shell deformations that will optimize the value of natural frequencies can be achieved by initially converting the shell geometry of FIG. 1 to a mesh, as shown in FIG. 3. The mesh is defined by a large number of grid squares with coordinates substantially conforming to the geometry defined by the bottom panel 12, side panels 14 and peripheral flange 16. The side panels 14 typically are too small to have natural frequencies that will be detected by humans and have formability issues with deep ribs. Hence, the side panels 14 require shallower ribs for optimal deformation design.

Figure 4:
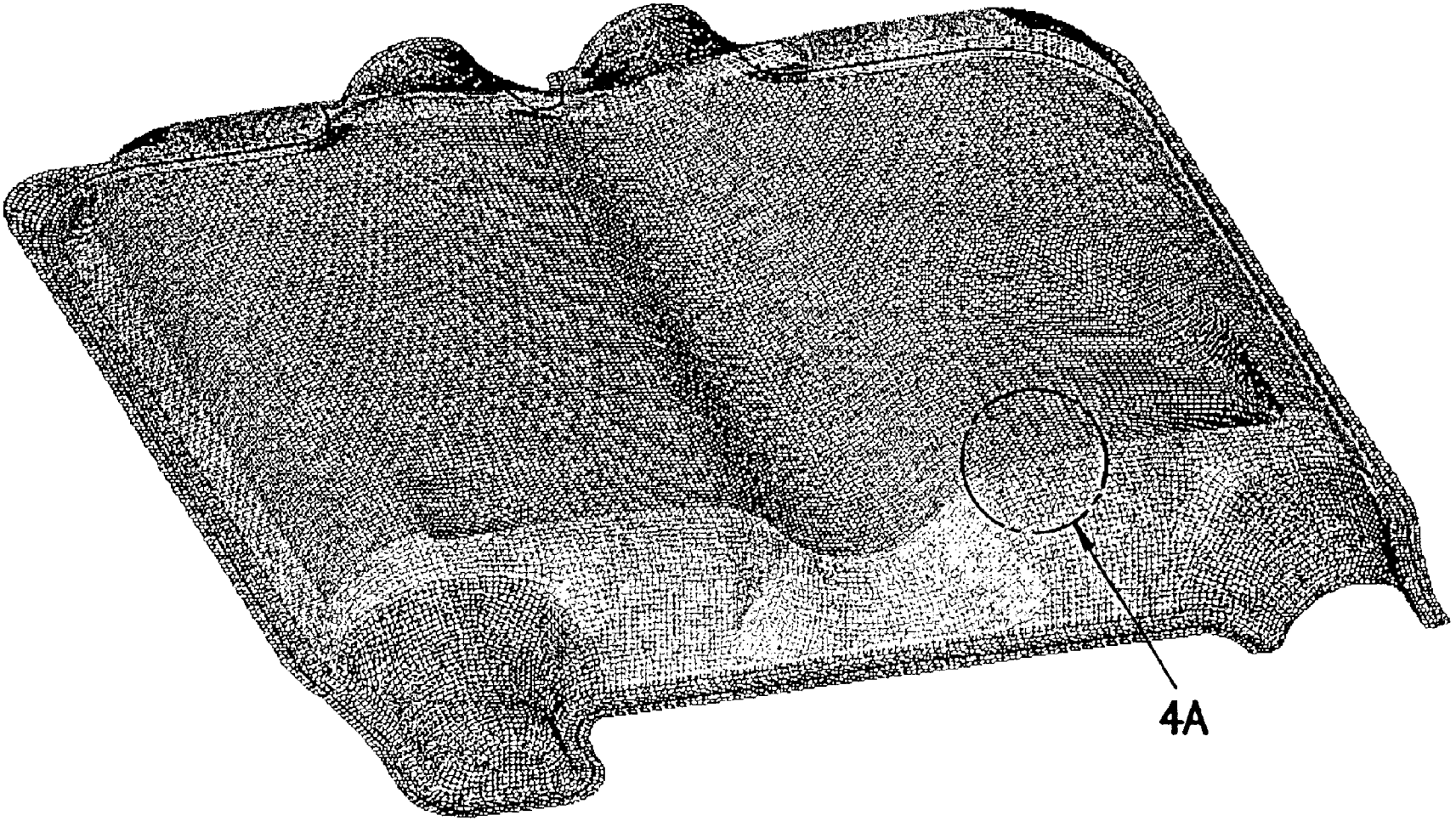
Figure 5:
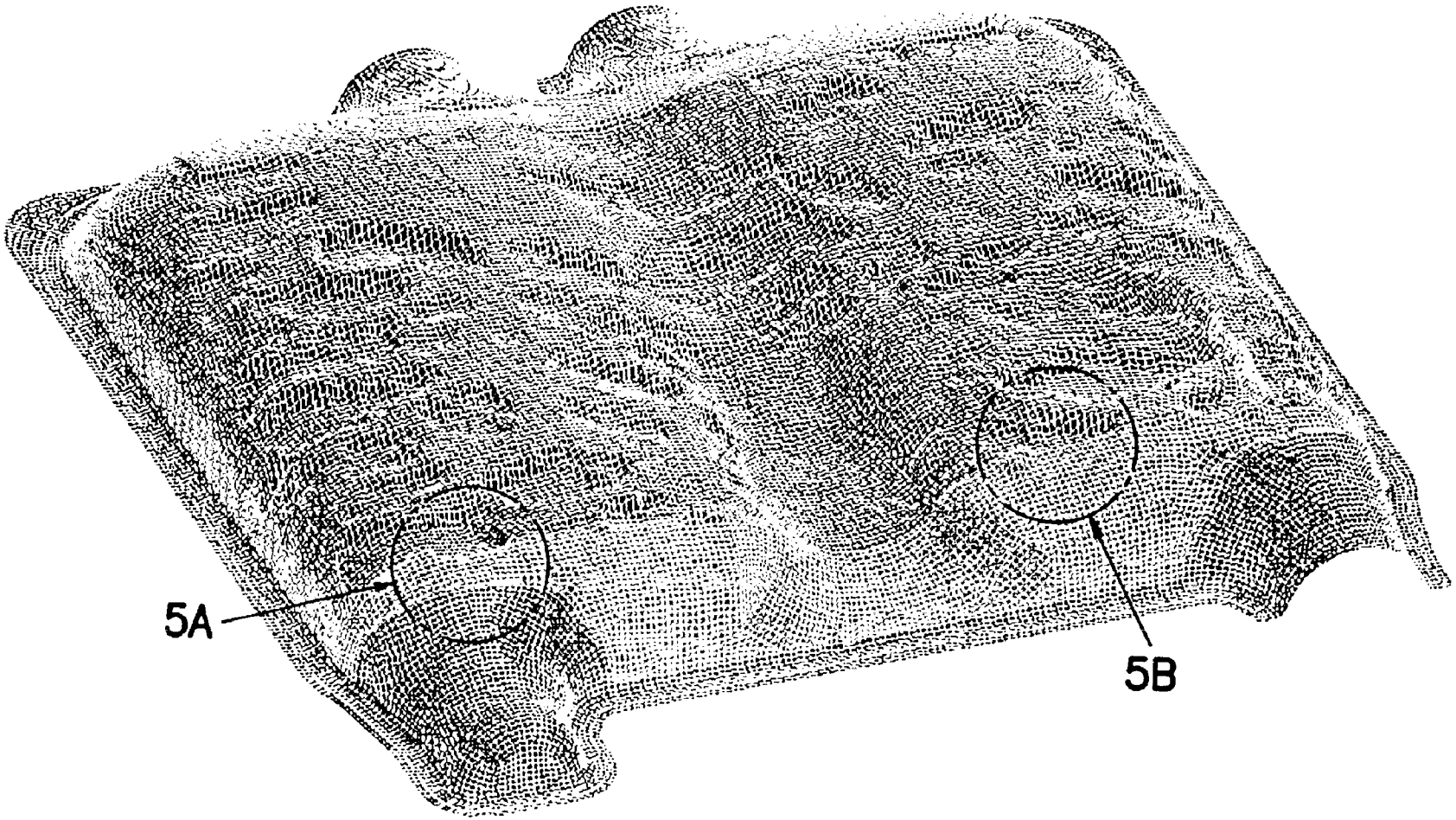
Figure 6:
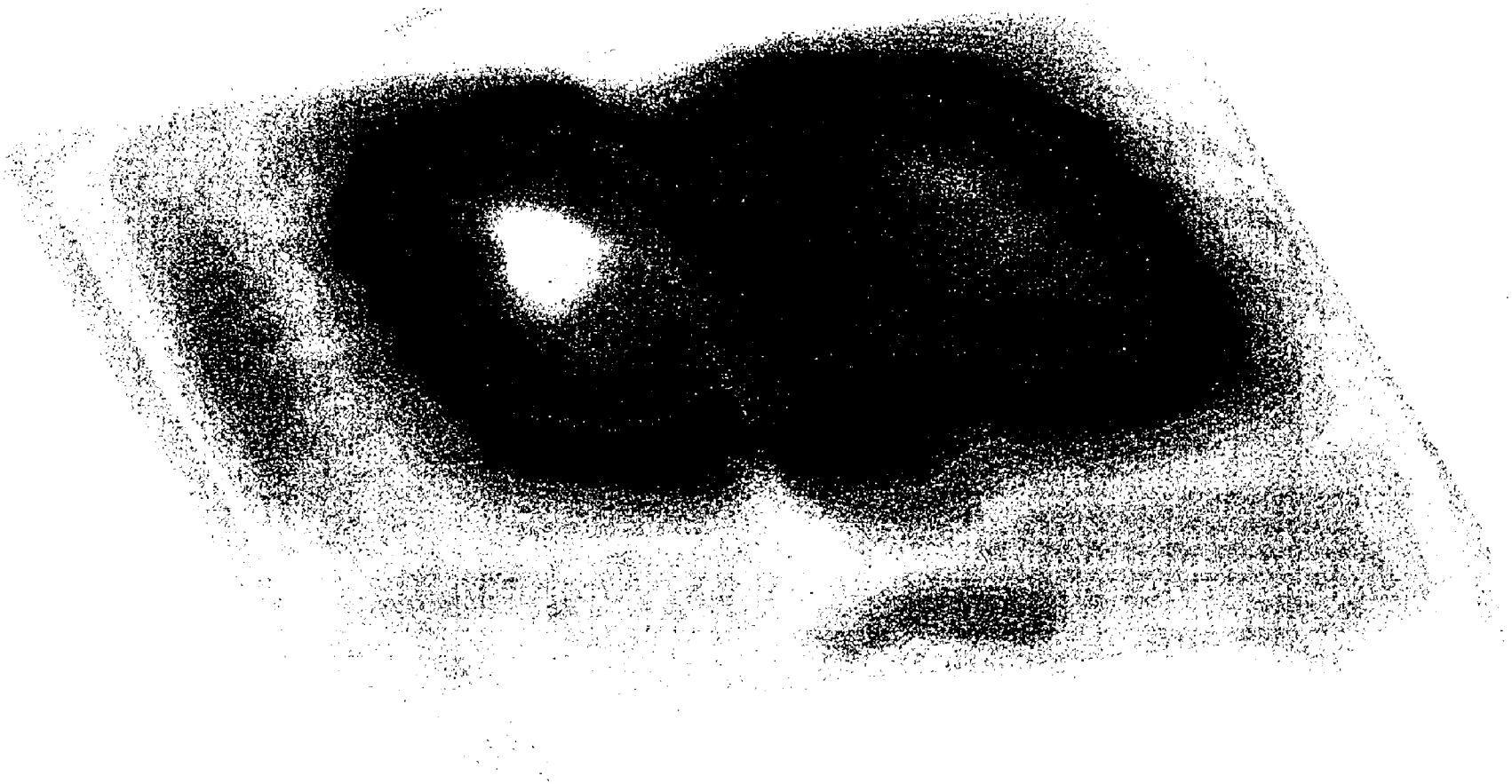
FIG. 6 is a perspective view similar to FIG. 2, but showing the location of the first natural frequency for the optimal theoretical geometry of FIG. 5.

The geometry of the panels 12 and 14 defined by the mesh of FIG. 4 is subject to a simulated deformation in which individual grid sections defined by the mesh in FIG. 4 are deformed relative to adjacent grid sections. The deformations are simulated initially at the locations of the most objectionable natural frequencies, and impacts of such deformations are assessed by the simulation. Through a series of iterations involving simulated shape changes to the panels 12 and 14, an optimum theoretical shape is determined for the panels 12 and 14 of the shell 10, as shown in FIG. 5. The optimal configuration shown in FIG. 5 includes tens of thousands of angularly aligned small intersecting panels of the mesh that had been shown in FIG. 4. Further simulation can assess the natural frequencies of the theoretical shape shown in FIG. 5. More particularly, FIG. 6 shows a simulation for the first natural frequency of the panel 10 shown in FIG. 5. A comparison of FIGS. 2 and 6 shows that the well defined isolated areas in FIG. 2 that would vibrate at the first natural frequency have been replaced by the frequency distribution pattern shown in FIG. 6 that would occur at a higher frequency.

The optimal hypothetical deformation pattern shown in FIG. 5, however, is substantially unmanufacturable in view of the complex angles defined by the tens of thousands of intersecting panels. More particularly, the metal could not be deformed in a cost effective manner to achieve the complex array of intersecting surfaces shown in FIG. 5. Conventional wisdom for designing mufflers would merely employ the output of FIG. 5 to select the location of parallel ribs to be formed in the shell 12. This process would require considerable engineering design time and both simulation and bench testing.

Figure 7:
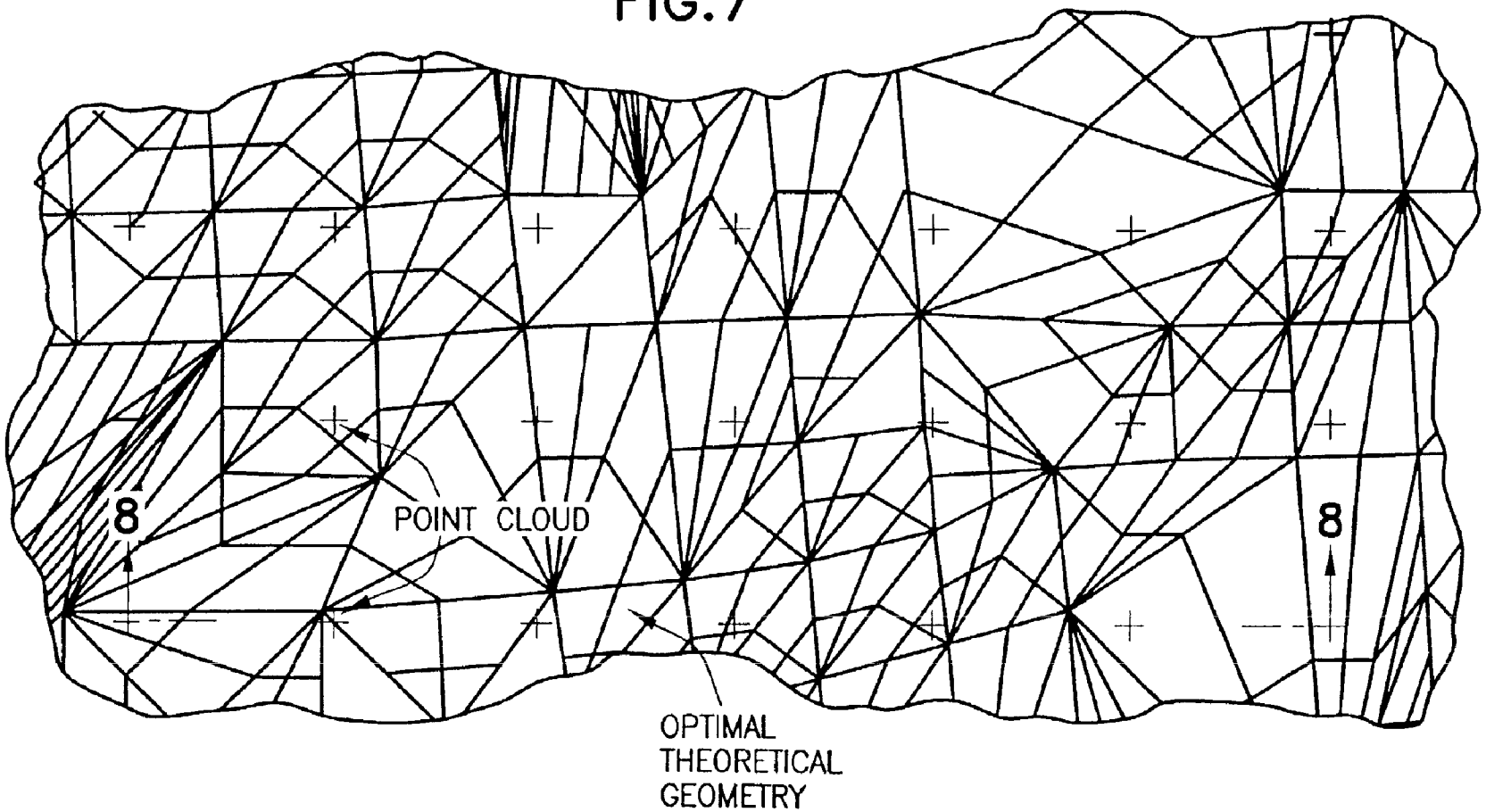
FIG. 7 is an enlarged plan view of a section of the optimal theoretically deformed panel shown in FIG. 5 with a two-dimensional point cloud projected thereon.
Figure 8:
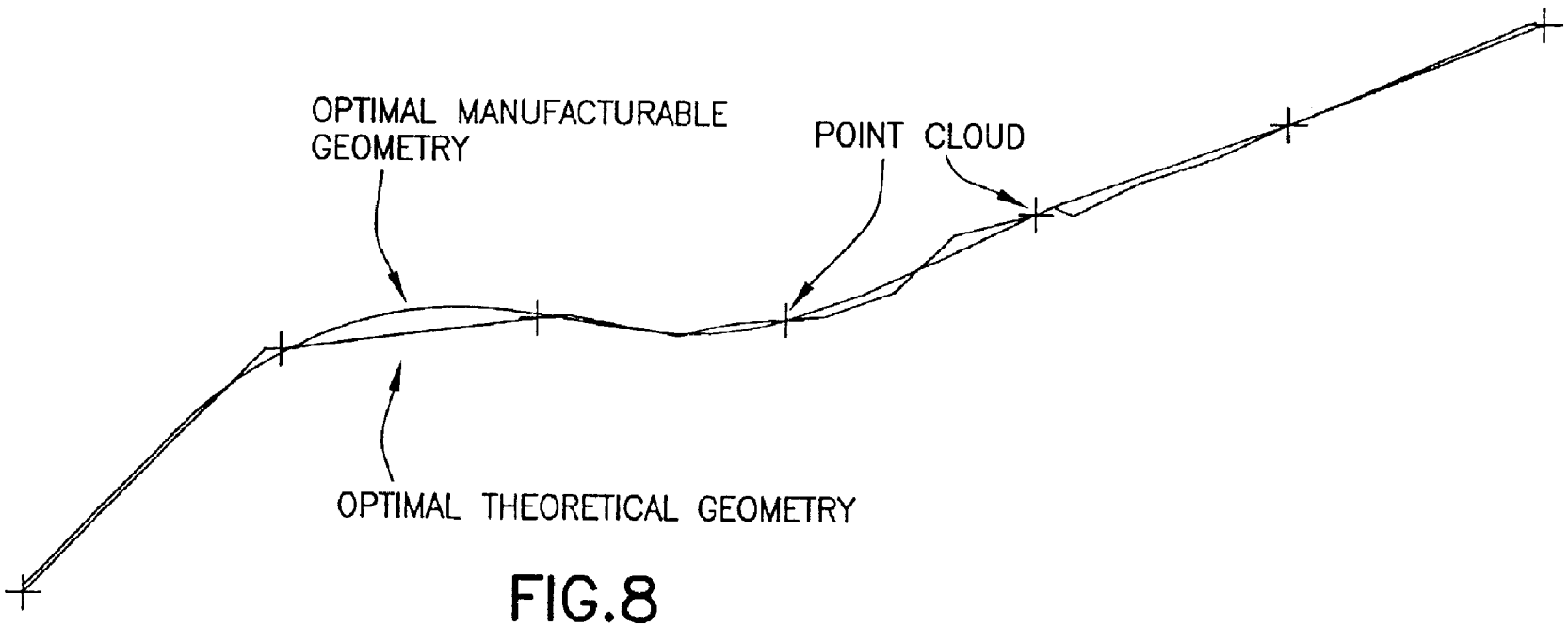
FIG. 8 is a cross-sectional view taken along line 8-8 in FIG. 7 and showing the optimal manufacturable shape.

The method of the invention proceeds by projecting a two-dimensional point cloud onto the optimal theoretical shape shown in FIG. 5. The two-dimensional point cloud, as shown in FIG. 7, defines a two-dimensional array of points that are spaced apart by a minimum selected bending radius for the sheet metal from which the panel is to be formed. A preferred spacing between points of the point cloud is 4.5 mm. However, distances between the points of the two dimensional point cloud will depend on the type and thickness of the metal. This projection of the two-dimensional point cloud onto the optimal theoretical shape effectively defines a three-dimensional point cloud. Sections of the optimal theoretical shape that lie between points of the point cloud and that lie on different facets or surfaces of the optimal theoretical shape are smoothed with radii conforming to the spacing between the points, as shown in FIG. 8. Thus, the optimal theoretical shape is converted into a manufacturable shape with fewer intersecting surfaces and smoother curves between the intersecting surfaces. The net result, as shown in FIG. 9 is an irregular array of discontinuities defined by smooth curves between intersecting planar surfaces substantially conforming to the optimal hypothetical geometry depicted in FIG. 5.

This process described above enables a decrease in the material thickness without sacrificing panel stiffness. Hence, vibration related noise can be controlled while achieving reduced weight and decreased cost. Additionally, design time can be reduced by avoiding the need for an engineer to design alternate rib patterns and test the various designed rib patterns for effectiveness in reducing vibration related noise.

The illustrated embodiment shows the design of deformations in the outer shell of a stamp formed muffler. However, the method disclosed herein can be used for heat shields, resonators, converter end cones, converter and muffler shells, end caps, internal baffles and internal panels for exhaust system components.

The embodiment discusses the use of a two-dimensional point cloud which is projected onto the optimal theoretical shape which is unmanufacturable. The point cloud is the desired geometry of use, but any geometry from which a surface can be made either directly or indirectly can be used. These geometries include but are not limited to lines, arcs and splines.

What is claimed is:

1. A method for designing a component of an exhaust system, the method comprising:

designing an original configuration for the exhaust system component; converting the configuration to a three-dimensional mesh; deforming the three-dimensional mesh to define an optimal theoretical shape for the exhaust system component to optimize natural frequencies of the exhaust system component; defining the three-dimensional mesh as a plurality of intersecting flat surfaces; projecting a two-dimensional point cloud onto the optimal theoretical shape; smoothing intersections of the flat surfaces between the points of the projected point cloud to define curves with a bend radius substantially equal to the distance between the points of the point cloud for defining an optimal manufacturable shape for the exhaust system component.

2. The method of claim 1, wherein the two-dimensional point cloud defines a two-dimensional rectangular grid.

3. The method of claim 2, wherein the grid of the two-dimensional point cloud comprises a plurality of points, said points being spaced from one another by a distance conforming to a minimum selected bending radius for material from which the exhaust system component is made.

4. The method of claim 2, wherein the grid of the two-dimensional point cloud comprises a rectangular away of points at a spacing of approximately 4.5 mm.

5. The method of claim 1, further comprising the steps of selected at least one panel on the original configuration, and simulating locations for at least a first natural frequency on the selected panel before deforming the three-dimensional mesh to define an optimal theoretical shape for the exhaust system component.

6. The method of claim 5 further comprising the step of simulating locations that will vibrate at least the first natural frequency after deforming the three-dimensional mesh to define an optimal theoretical shape.

7. The method of claim 1, wherein after designing the original configuration, the method further comprises the step of selecting at least one panel of the original configuration and performing subsequent method steps on the panel.

8. A method for manufacturing an exhaust system, the method comprising:

designing an original configuration for the exhaust muffler based on space availability and exhaust flow characteristics;

converting the original configuration digitally to a three-dimensional digital mesh;

simulating locations on the three-dimensional mesh that will vibrate at at least a first natural frequency;

digitally deforming the three-dimensional mesh to define an optimal theoretical shape for the exhaust muffler to optimize the natural frequencies of the exhaust muffler;

defining the optimized three-dimensional mesh as a plurality of intersecting flat surface;

digitally projecting a two-dimensional point cloud onto the intersecting flat surfaces;

smoothing intersections of the panels between the points of the projected point cloud to define curves with a bend radius substantially equal to distances between the points of the point cloud for defining an optimal manufacturable shape for the exhaust muffler;

providing a sheet of metal; and deforming the sheet of metal to conform to the optimal manufacturable shape.

* * * * *